US006908310B1

(12) United States Patent
Olsson et al.

(10) Patent No.: US 6,908,310 B1
(45) Date of Patent: Jun. 21, 2005

(54) SLIP RING ASSEMBLY WITH INTEGRAL POSITION ENCODER

(75) Inventors: Mark S. Olsson, La Jolla, CA (US); Jeffrey A. Prsha, San Diego, CA (US)

(73) Assignee: Deepsea Power & Light, San Diego, CA (US)

( * ) Notice: Subject to any disclaimer, the term of this patent is extended or adjusted under 35 U.S.C. 154(b) by 0 days.

(21) Appl. No.: 10/799,473

(22) Filed: Mar. 11, 2004

(51) Int. Cl.[7] ..... H01R 39/00
(52) U.S. Cl. ..... 439/26
(58) Field of Search ..... 439/26, 23, 24, 439/25

(56) References Cited

U.S. PATENT DOCUMENTS

| | | | | |
|---|---|---|---|---|
| 3,960,012 | A | 6/1976 | Ingram | 73/136 |
| 3,972,224 | A | 8/1976 | Ingram | 73/114 |
| 4,447,752 | A | 5/1984 | Boyce et al. | 310/232 |
| 4,618,793 | A | 10/1986 | Shizuka et al. | 310/232 |
| 4,888,986 | A | 12/1989 | Baer et al. | 73/188 |
| 4,943,137 | A | 7/1990 | Speer | 350/96.18 |
| 5,557,975 | A | 9/1996 | Crane et al. | 73/862 |
| 5,829,148 | A * | 11/1998 | Eaton | 33/503 |
| 5,837,909 | A | 11/1998 | Bill et al. | 73/862 |
| 5,865,629 | A * | 2/1999 | Bernardini | 439/26 |
| 6,517,357 | B1 * | 2/2003 | Athanasiou et al. | 439/26 |
| 6,561,813 | B2 | 5/2003 | Rutten et al. | 439/26 |
| 6,611,661 | B2 | 8/2003 | Buck | 396/19 |

* cited by examiner

*Primary Examiner*—Tho D. Ta
(74) *Attorney, Agent, or Firm*—Michael H. Jester

(57) ABSTRACT

A plurality of contact rings are supported in spaced relation on a cylindrical body about a common axis. A housing is located adjacent the contact rings and is configured to permit relative rotation between the contact rings and the housing about the common axis. A plurality of contact brushes each have a proximal end connected to a printed circuit board (PCB). A distal end of each of the contact brushes is slidably engaged with a corresponding one of the contact rings. Optionally a signal generating portion of a position encoder may be mounted on the PCB. The position encoder has a reference portion that is mounted on the cylindrical body.

20 Claims, 6 Drawing Sheets

SLIP RING ASSEMBLY WITH INTEGRAL POSITION ENCODER

FIELD OF THE INVENTION

The present invention relates to electromechanical couplers, and more particularly, to slip ring assemblies which are used to maintain multiple electrical connections through a rotating joint.

BACKGROUND OF THE INVENTION

In constructing various electromechanical devices there is frequently a need to transmit power and/or electrical signals from a stationary structure to a rotating structure. One well known example is a radar antenna that continuously rotates through three hundred and sixty degrees of motion. A special type of electromechanical connection is required in such cases, which is most often referred to as a "slip ring", but it may also be called a rotary electrical joint, collector or electric swivel. Any electromechanical system that requires unrestrained intermittent or continuous rotation while also transmitting power and/or data can utilize a slip ring to great advantage. Typically in a slip ring a plurality of resilient, elongated metal or carbon conductors contact and slide over corresponding conductive contact rings. See for example U.S. Pat. No. 6,611,661 granted Aug. 26, 2003 of Buck. The design of a slip ring can improve mechanical performance of the system, and improve reliability by eliminating dangling wires that can break or become tangled. Fiber optic rotary joints (FORJ's) have also been specially designed for high-speed data transfer in EMI sensitive environments. While slip rings have been widely used for decades, little attention has been paid to improving their simplicity and versatility. Therefore, it would be desirable to provide an improved slip ring assembly that is more functional, cost-effective and reliable, and has improved features of use and operation.

In accordance with the present invention, a slip ring assembly includes a plurality of contact rings and means for supporting the contact rings in spaced relation about a common axis. A housing is located adjacent the contact rings and is configured to permit relative rotation between the contact rings and the housing about the common axis. A plurality of contact brushes each have a proximal end connected to means mounted to the housing for supporting a circuit. The circuit supporting means may include one or more printed circuit boards (PCBs) or it may be comprised of other circuit supporting structures. A distal end of each of the contact brushes is slidably engaged with a corresponding one of the contact rings. Optionally a signal generating portion of a position encoder may be mounted on the circuit supporting means. The position encoder has a reference portion that is mounted on the contact ring supporting means.

DETAILED DESCRIPTION

There are many devices that can take advantage of our novel slip ring assembly. One of these is a video pipe inspection system that is used to provide a real time image of the inside of a buried tubular structure, search for defects, leaks or obstructions in drain pipes, water pipes, well casings, gas pipes, electrical conduits, and so forth.

Figure 1:
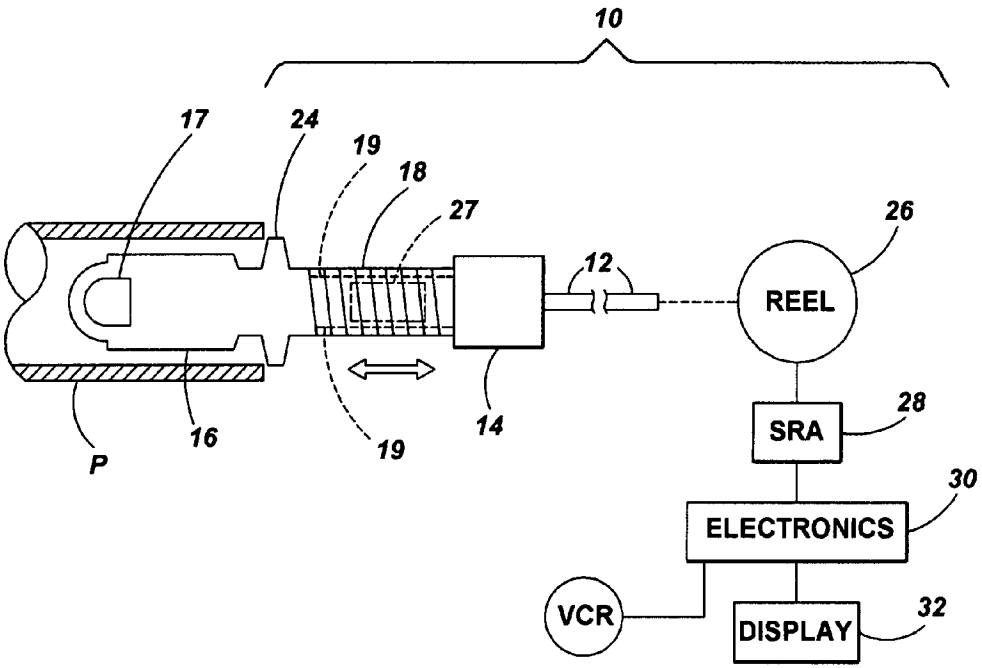
FIG. 1 is a functional block diagram of a video pipe inspection system incorporating the slip ring assembly of the present invention.

Referring to FIG. 1, a video pipe inspection system 10 includes an elongate, resilient and flexible video push cable 12. Examples of suitable video push cables are disclosed in U.S. Pat. No. 5,457,288 granted Oct. 10, 1995 to Mark S. Olsson and U.S. Pat. No. 5,808,239 granted Sep. 15, 1998 to Mark S. Olsson, the entire disclosures of which are hereby incorporated by reference. Both of said patents are assigned to DeepSea Power & Light, the assignee of the subject application. The forward or distal end of the push cable 12 is operatively connected through an electromechanical termination assembly 14 to a video camera head 16 which includes a rugged generally cylindrical outer stainless steel housing with a hollow interior for enclosing a black and white or color video camera 17. Further details of the termination assembly 14 are disclosed in the aforementioned U.S. Pat. No. 5,457,288. The video camera 17 includes an optical sensing device such as an array of charge-coupled-devices (CCDs) with adjacent color filter elements. The video camera head 16 further includes a camera circuit which receives the output of the CCD and generates a video image signal representing real time images of scenes viewed by the optical sensing device through a forward end of the video camera head 16. The video camera head 16 may function with video systems employing EIA, NTSC, CCIR, PAL and other standard video signal formats.

A stainless steel coil spring 18 surrounds the push cable 12 and is coupled between the rear end of the video camera head 16 and the termination assembly 14. The coil spring 18 could also be plastic with armor or some other suitable material. The coil spring 18 provides the desirable amount of flexibility to permit the video camera head 16 to negotiate tight turns in a pipe P being internally inspected. The pipe P is usually buried in the ground and typically includes at least one turn. Two stainless steel aircraft cables 19 or other suitable connecting hardware attach the video camera head 16 to the termination assembly 14. The connection hardware extends longitudinally within the spring 18 and limits its extension. This facilitates removal of the video camera head 16 from the pipe P if it gets stuck.

The video camera head 16 is preferably dimensioned for insertion into pipes having internal diameters as small as two inches. With advancements in video camera miniaturization, the video camera head 16 can be designed to fit within pipes having internal diameters of one inch or less. A light source is mounted in the forward end of the video camera head 16 comprising a plurality of white LEDs (not illustrated). A large number of LEDs provides sufficient illumination for the color video camera 17. The scene that is illuminated by the LEDs is the interior of the pipe P, including its interior walls and any objects or debris within the pipe. A plurality of red LEDs could be used in connection with red-spectrum sensitive CCDs incorporated in black and white camera systems. In some applications infrared LEDs may be suitable. Preferably the circuit that drives the LEDs has a feedback control so that the power dissipated by the LEDs does not cause excessive heat that would adversely affect the signal-to-noise ratio of the CCDs in the video camera. The video camera head 16 preferably has a fixed focus lens group consisting of lens elements (not illustrated) that provide a wide viewing angle with substantial depth of field, thereby eliminating the need for remote focusing in most applications. Preferably the video camera head 16 is constructed so that it is waterproof to a depth of at least three hundred and thirty feet and is capable of withstanding pressures of at least one hundred and fifty pounds per square inch (PSI). Further details of the video camera head 16 are found in co-pending U.S. patent application Ser. No. 09/506,181 filed Feb. 17, 2000 of Mark S. Olsson, also assigned to DeepSea Power & Light, the entire disclosure of which is hereby incorporated by reference.

Optionally deformable plastic fins 24 (FIG. 1) extend radially from the exterior of the video camera head 16 to centrally position and guide the camera head within the pipe P. The fins 24 or a dolly with wheels (not illustrated) are preferably releaseably coupled to the coil spring 18 via a unique C-shaped clamping arrangement disclosed in co-pending U.S. patent application Ser. No. 10/278,549 filed Oct. 22, 2002 of Eric Chapman et al., the entire disclosure of which is hereby incorporated by reference. Said application is also assigned to DeepSea Power & Light. The push cable 12 may extend several hundred feet within the pipe P between the termination assembly 14 and a push reel 26. The push reel 26 preferably comprises a roto-molded plastic annular body roughly similar in overall shape and size to an automobile tire. The push cable 12 is wound into continuous circular coils or turns inside the push reel 26. Due to its resilience, the coils of the push cable 12 push radially outwardly and are restrained by the annular cylindrical wall of the push reel 26. The push reel 26 is manually rotatable about a horizontal axis on a stationary frame (not illustrated) that supports the push reel 26 to pay out the push cable 12 from a circular central opening on one side of the push reel 26. This forces the video camera head 16 down the pipe P. The push cable 12 must be pulled back out of the pipe P and pushed back inside the push reel 26 to withdraw the camera head 16.

It is important for the video pipe inspection system 10 to be able to accurately measure the amount of push cable 12 that has been payed out or wound back to the push reel 26. This allows breakages or blockages in the pipe P to be accurately located so that defective segment of pipe can be excavated and repaired or cleared with a snake, for example. An electromagnetic signal transmitter 27 (FIG. 1) is mounted inside the coil spring 18 and powered via the push cable 12. The transmitter 27 emits electromagnetic signals that can be detected by portable hand-held proximity locating equipment so that the location of the camera head can be tracked. An example of a hand-held portable locator is disclosed in co-pending U.S. patent application Ser. No. 10/308,752 filed Dec. 3, 2002 of Mark S. Olsson et al., the entire disclosure of which is hereby incorporated by reference. Said application is assigned to DeepSea Power & Light. The transmitter 27 preferably includes a flexible bundle of high magnetic permeability material such as low carbon braided steel wire encased in electrical insulation material. This flexible bundle extends through a donut-shaped exciter coil. Further details of the transmitter 27 may be found in co-pending U.S. patent application Ser. No. 10/061,887 filed Jan. 31, 2002 of Mark S. Olsson et al., the entire disclosure of which is hereby incorporated by reference. Said application is assigned to DeepSea Power & Light.

A plumber or other workman using the video pipe inspection system 10 may not have a portable hand-held locator available to him or may not be familiar with its operation. Moreover, accurate location of the video camera head 16 using a hand-held portable locator that detects electromagnetic signals emitted by the transmitter 27 may not be as accurate as desired or may be difficult where reception is poor. Therefore, the system 10 includes a position encoder (not illustrated in FIG. 1) that detects the amount and direction of rotation of the push reel 26 relative to the stationary frame that supports the push reel 26, for example, using quadrature encoding techniques. The amount and direction of rotation of the push reel 26 sensed by the position encoder can be used to calculate the amount of push cable 12 payed out of the push reel 26. This in turn indicates the precise location of the video camera head 16 within the pipe P and thus the location of the obstruction, leak or defect in the pipe. Further details of the push reel 26, its axle and support frame are disclosed in U.S. Pat. No. 6,545,704 granted Apr. 8, 2003 to Mark S. Olsson et al., the entire disclosure of which is hereby incorporated by reference. Said patent is also assigned to DeepSea Power & Light. The video signal transmitted over the push cable 12 passes through a slip ring assembly (SLA) 28, a portion of which rotates with the push reel 26 and another portion of which stays stationary with the frame that supports the push reel 26. The slip ring assembly 28 allows video, power and ground conductors routed over the stationary frame to be connected through the axle of the push reel 26 to corresponding conductors in the push cable 12 at its proximal end. The slip ring assembly 28 permits these electrical connections to be maintained while the coil of the push cable 12 wound within the push reel 26 rotates around the axis of rotation of the push reel 26. As hereafter described in detail, the position encoder is integrated into the slip ring assembly 28. The video signal from the video camera 17, and a signal generated by the position encoder, are processed by an electronic circuit 30. Real time video images of the interior of the pipe P are shown on a display 32 with overlaid alphanumeric distance, time and date information, all of which are recorded on a video recorder ("VCR") or other recording device such as a magnetic or optical disk drive.

Figure 2:
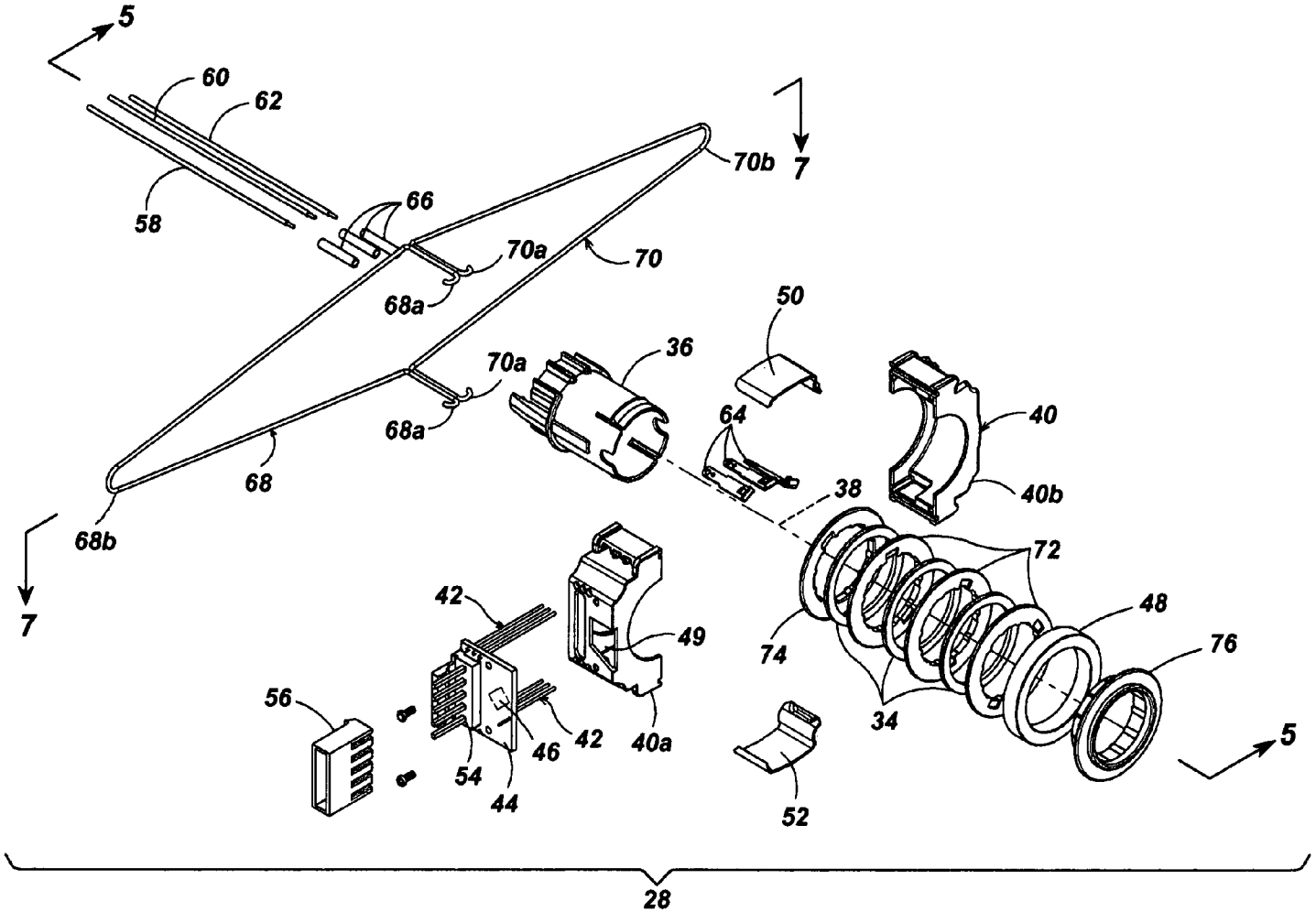
FIG. 2 is an exploded isometric view of an embodiment of the slip ring assembly of the present invention.
Figure 3:
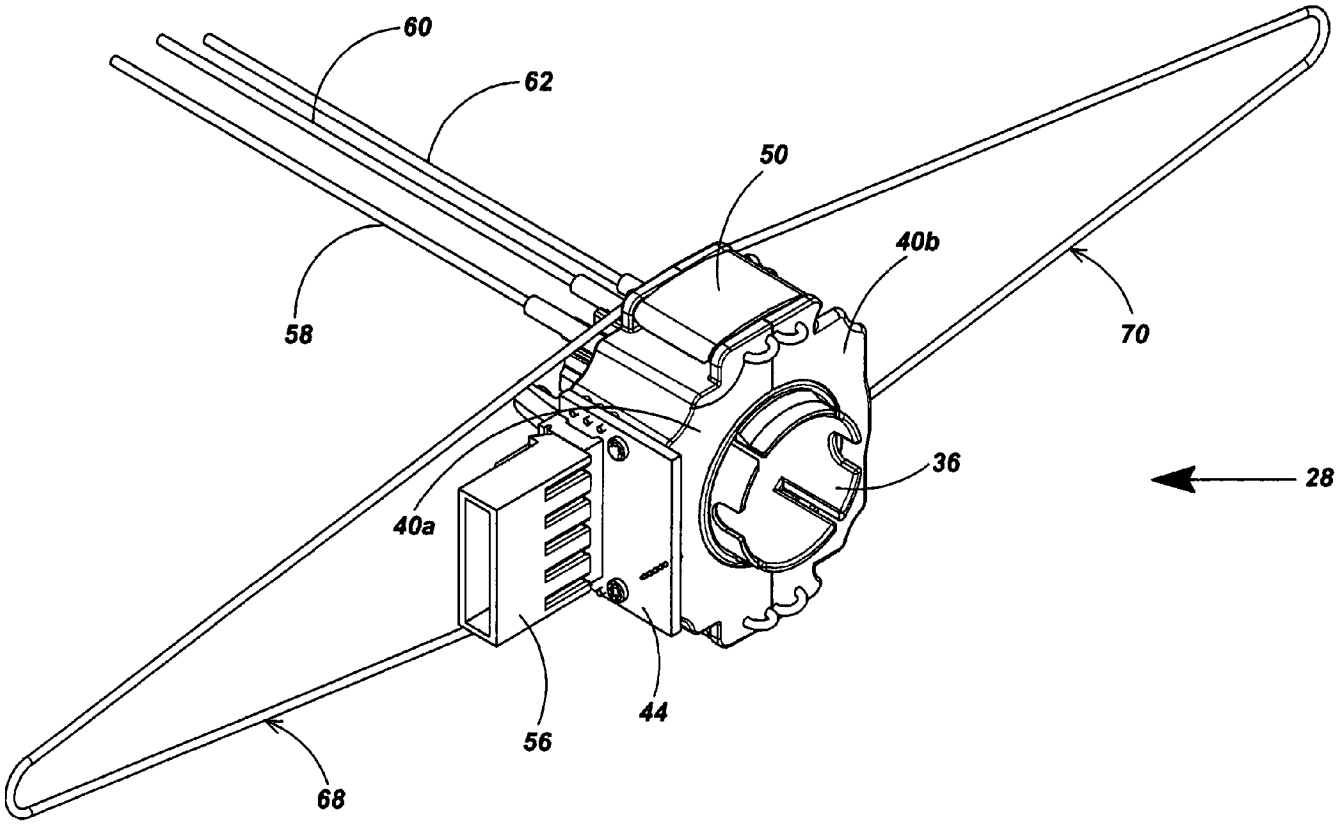
FIG. 3 is an isometric view of the slip ring assembly of FIG. 2 in its assembled state taken from the front side.
Figure 5:
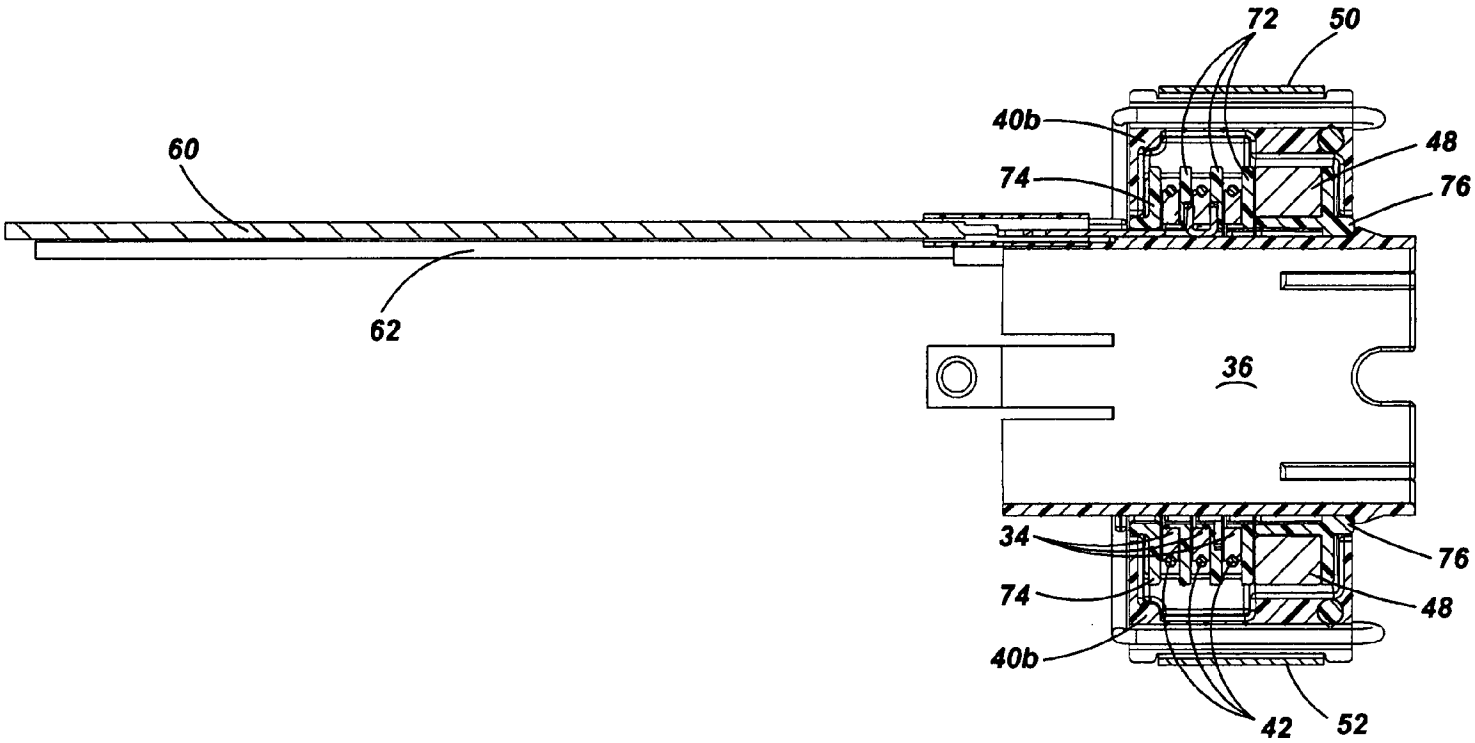
FIG. 5 is an enlarged longitudinal sectional view of the slip ring assembly of FIG. 2 in its assembled state but otherwise taken along line 5—5 of FIG. 2.
Figure 7:
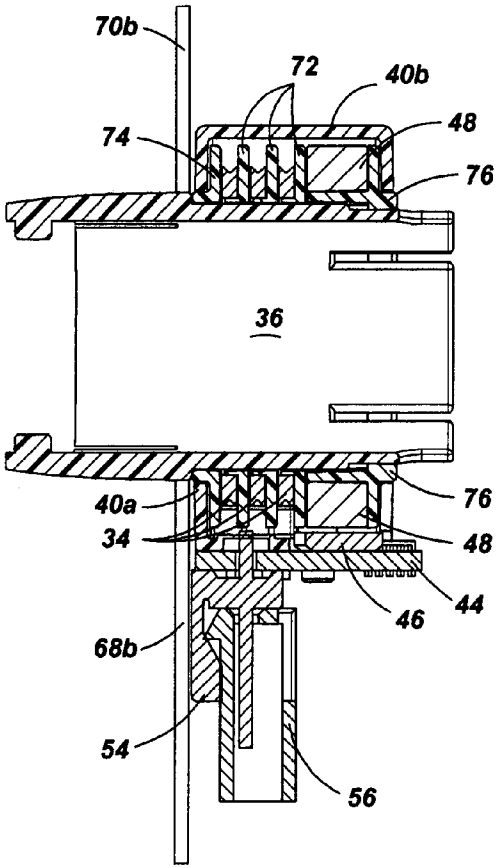
FIG. 7 is an enlarged transverse sectional view of the slip ring assembly of FIG. 2 in its assembled state but otherwise taken along line 7—7 of FIG. 2.

Referring to FIGS. 2 and 3, the slip ring assembly (SRA) 28 includes a plurality of contact rings 34 and a cylindrical plastic slip ring body 36 (FIGS. 2, 5 and 7) for supporting the contact rings 34 in spaced relation about a common axis 38. A housing 40 (FIG. 2) comprising mating shell halves 40*a* and 40*b* is located adjacent the contact rings 34 and is configured to permit relative rotation between the contact rings 34 and the housing about the common axis 38. A plurality of contact brushes 42 each have an inner or proximal end connected to a printed circuit board (PCB) 44 that provides a means mounted to the housing 40 for supporting a circuit. The circuit supporting means may include one or more PCB or it may be comprised of other circuit supporting structures such as one or more flexible circuit boards, injection molded circuit boards, ceramic circuit boards, frames, dedicated connectors, etc. An outer or distal end of each of the contact brushes 42 is slidably engaged with a corresponding one of the contact rings 34.

The contact brushes may be made out of suitable electrically conductive metal or they can be made out of carbon.

Optionally a signal generating portion 46 of a position encoder may be mounted on the PCB 44. The position encoder has a reference portion 48 that is mounted on the slip ring body 36. The signal generating portion 46 of the position encoder is preferably a Hall effect sensor mounted on the PCB 44. The reference portion 48 of the position encoder is preferably a magnetic ring Preferably the magnetic ring is made up of powdered magnetic material molded into the required cylindrical shape and magnetized to provide the needed resolution, for example, sixty-six circumferentially spaced magnetic domain regions. The Hall effect sensor detects the passage of the magnetic domain regions through a window or recess 49 formed in the shell half 40*a*. Other forms of position encoder could be utilized such as a well known optical encoder having an emitter-detector pair mounted on the PCB 44 and a slotted disk mounted on the slip ring body 36. The position encoder could also be provided in the form of a single magnet with a rotating reluctor or it could employ a ratiometric method such as a potentiometer, differential transformer, or optical analog system. However, it is believed at the present time that the combination of the Hall effect sensor and the magnetic ring are best suited for use in the pipe inspection system 10 which encounters substantial physical abuse, dirt, water and other harsh environmental effects. An indexing method can be employed so that the electronic circuit 30 can derive a zero degree position.

Figure 6:
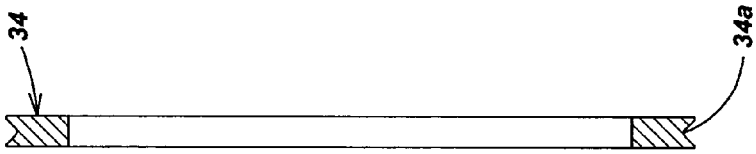
FIG. 6 is a greatly enlarged side elevation view of one of the contact rings of the slip ring assembly of FIG. 2 showing the V-shaped groove in its perimeter in which the distal ends of an opposing pair of contact brushes slide.
Figure 4:
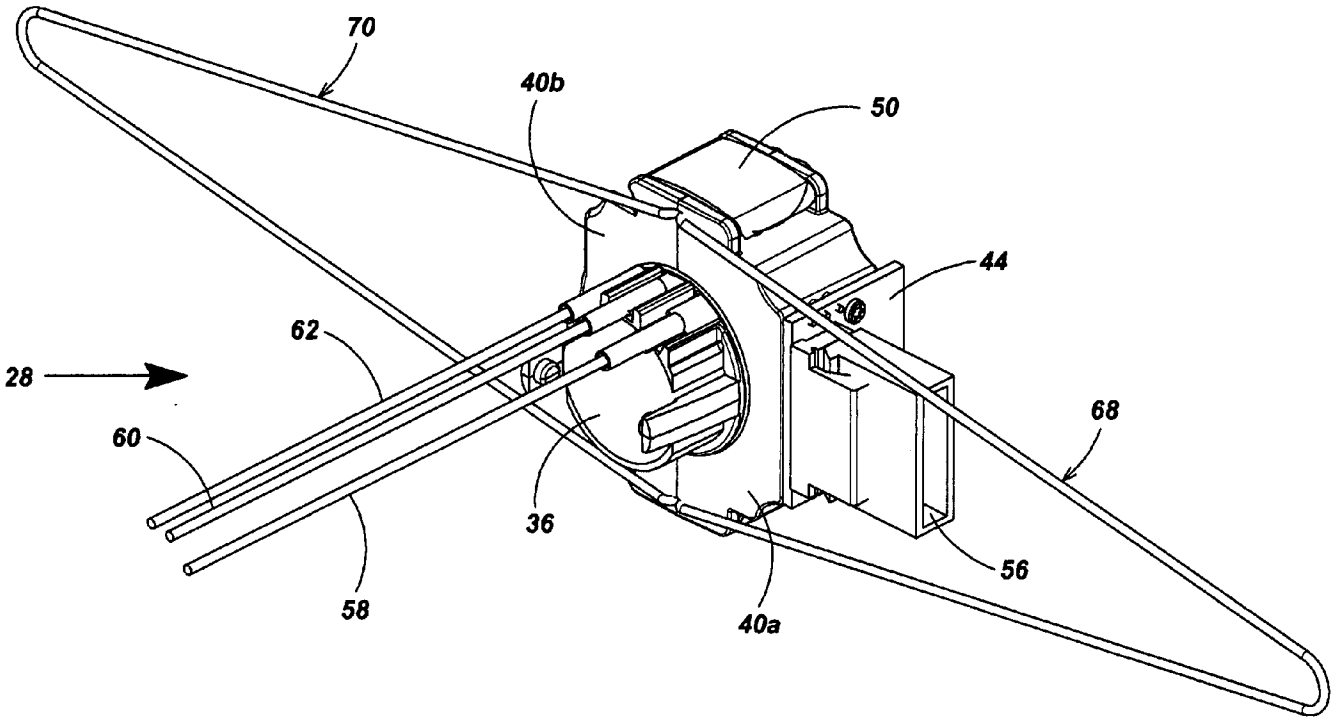
FIG. 4 is an isometric view of the slip ring assembly of FIG. 2 in its assembled state taken from the back side.

The shell halves 40*a* and 40*b* enclose the contact rings 34 and the reference portion 48 of the position encoder. The shell halves 40*a* and 40*b* are removably held together by upper and lower metal clips 50 and 52. This allows the slip ring assembly 28 to be readily disassembled for maintenance or repair. The clasping function of the upper metal clip 50 relative to shell halves 40*a* and 40*b* is visible in FIGS. 3 and 4. The contact brushes 42 are arranged on opposite sides of the PCB 44 in two groups as illustrated in FIG. 2. The distal ends of opposing pairs of the contact brushes 42 ride in a V-shaped groove 34*a* (FIG. 6) formed in the outer perimeter of a common one of the contact rings 34. The contact brushes are resilient and apply a spring force to their corresponding contact rings 34. Thus each contact ring 34 is lightly squeezed between an opposing pair of the contact brushes 42 to ensure a positive electrical connection with the contact ring 34. The contact rings 34 are preferably made of a material consisting of ninety-five weight percent Silver and five weight percent graphite for improved lubricity.

A male portion 54 of an electrical connector is mounted on the PCB 44. A female portion 56 of the electrical connector can be mated with the male portion 54. Suitable electrical connectors of the type illustrated are commercially available under the trademarks AMPS, BERG®, MOLLEX® and others. Conductive traces (not illustrated) formed on the PCB 44 electrically interconnect separate corresponding prong conductors in the male portion 54 of the electrical connector to the signal generating portion 46 of the encoder and the proximal ends of each of contact brushes 42. This allows the power, ground and video signals to be routed through corresponding ones of the contact rings 34 to insulated wire leads 58, 60 and 62. Each of the contact rings 34 has an electrical contact clip 64 soldered or otherwise bonded thereto for electrically connecting the wire leads 58, 60 and 62 (FIG. 2) and the connections are protected via shrink tube segments 66.

Wire wings 68 and 70 (FIGS. 3 and 4) have their inner hooked portions 68*a* and 70*a* retained in corresponding recesses molded into the shell halves 40*a* and 40*b*. The outer portions 68*b* and 70*b* of the wire wings 68 and 70 are held in molded recesses in the push reel 26 (not illustrated) to cause relative rotation between the contact rings 34 and the contact brushes 42 when the push reel 26 is rotated on its support frame. The engagement of the wire wings 68 and 70 with the push reel 26 similar causes relative rotation of the Hall effect sensor relative to the magnetic ring when the push reel 26 is rotated on its support frame. See FIGS. 4–6 of U.S. Pat. No. 6,545,704 for illustrations of the configuration of tire-shaped the push reel 26. A plurality of ring spacers 72 are carried on the slip ring body 36 on opposite sides of the contact rings 34. The ring spacers 72 are preferably made of dielectric material with good electrical insulating properties and low friction, such as Nylon® plastic. The contact brushes 42 are prevented from touching any other contact rings 34 besides their assigned contact ring by the ring spacers 72 as can best be seen from FIGS. 5 and 7. A top ring spacer 74 is mounted about the slip ring body 36 towards one end thereof and a cylindrical end cap 76 is mounted about the slip ring body 36 towards the other end thereof. The top ring spacer 74 and the cylindrical end cap 76 are also made of a suitable dielectric material, such as Teflon® filled acetal sold under the trademark Delrin AF®.

While we have described an example of our slip ring assembly 28 in detail, and one suitable system 10 in which it can be used to advantage, it should be apparent to those skilled in the art that our invention can be modified in both arrangement and detail. Therefore the protection afforded our invention should only be limited in accordance with the following claims.

We claim:

1. A slip ring assembly, comprising:

a plurality of contact rings;

means for supporting the contact rings in spaced relation about a common axis;

a housing located adjacent the contact rings and configured to permit relative rotation between the contact rings and the housing about the common axis;

means mounted to the housing for supporting a circuit;

a plurality of contact brushes each having a proximal end connected to the circuit supporting means and a distal end slidably engaged with a corresponding one of the contact rings; and a position encoder having a signal generating portion mounted on the circuit supporting means and a reference portion mounted on the contact ring supporting means.

2. The slip ring assembly of claim 1 wherein the housing includes a pair of shells that enclose the contact rings and reference portion of the position encoder.

3. The slip ring assembly of claim 1 wherein the circuit supporting means includes at least one printed circuit board.

4. The slip ring assembly of claim 1 wherein the contact brushes apply a spring force to their corresponding contact rings.

5. The slip ring assembly of claim 1 wherein the signal generating portion of the position encoder is a Hall effect sensor mounted on the circuit supporting means and the reference portion of the position encoder is a magnetic ring with a plurality of separate circumferentially spaced magnetic domain regions.

6. The slip ring assembly of claim 1 wherein a portion of an electrical connector is mounted on the circuit supporting means.

7. The slip ring assembly of claim 1 wherein the contact ring supporting means includes a generally cylindrical body.

8. The slip ring assembly of claim 1 wherein each of the contact rings has an electrical contact clip connected thereto.

9. The slip ring assembly of claim 1 wherein the distal end of each contact brush rides in a groove formed in the outer perimeter of the corresponding contact ring.

10. The slip ring assembly of claim 1 and further comprising a plurality of ring spacers carried on the contact ring supporting means on opposite sides of the contact rings.

11. A slip ring assembly, comprising:

a plurality of contact rings;

means for supporting the contact rings in spaced relation about a common axis;

a housing located adjacent the contact rings and configured to permit relative rotation between the contact rings and the housing;

a planar printed circuit board mounted to the housing; and a plurality of contact brushes extending substantially perpendicular to the printed circuit board and each having a proximal end connected to the printed circuit board and a distal end slidably engaged with a corresponding one of the contact rings.

12. The slip ring assembly of claim 11 wherein the housing includes a pair of shells that enclose the contact rings and reference portion of the position encoder.

13. The slip ring assembly of claim 11 wherein the contact brushes apply a spring force to their corresponding contact rings.

14. The slip ring assembly of claim 11 wherein a portion of an electrical connector is mounted on the printed circuit board.

15. The slip ring assembly of claim 11 wherein the contact ring supporting means includes a generally cylindrical body.

16. The slip ring assembly of claim 11 wherein the distal end of each contact brush rides in a groove formed in the outer perimeter of the corresponding contact ring.

17. The slip ring assembly of claim 11 and further comprising a plurality of ring spacers carried on the contact ring supporting means on opposite sides of the contact rings.

18. The slip ring assembly of claim 11 and further comprising a position encoder having a signal generating portion mounted on the printed circuit board and a reference portion mounted on the contact ring supporting means.

19. The slip ring assembly of claim 18 wherein the signal generating portion of the position encoder is a Hall effect sensor mounted on the printed circuit board and the reference portion of the position encoder is a magnetic ring with a plurality of separate circumferentially spaced magnetic domain regions.

20. A slip ring assembly, comprising:

a cylindrical slip ring body;

a plurality of contact rings supported on the slip ring body in spaced relation about an axis of the slip ring body;

a plurality of ring spacers supported on the slip ring body on opposite sides of the contact rings;

a housing located adjacent the contact rings and configured to permit relative rotation between the contact rings and the housing;

a printed circuit board mounted to the housing;

a plurality of contact brushes each having a proximal end connected to the printed circuit board and a distal end slidably engaged with a corresponding one of the contact rings, the contact brushes applying a spring force to their corresponding contact rings;

a position encoder having a signal generating portion mounted on the printed circuit board and a reference portion mounted on the slip ring body; and a portion of an electrical connector mounted on the printed circuit board.

* * * * *

UNITED STATES PATENT AND TRADEMARK OFFICE

CERTIFICATE OF CORRECTION

PATENT NO. : 6,908,310 B1 
DATED : June 21, 2005
INVENTOR(S) : Mark S. Olsson and Jeffry A. Prsha It is certified that error appears in the above-identified patent and that said Letters Patent is hereby corrected as shown below:

Column 1,
Between lines 37 and 38, insert the heading -- SUMMARY OF THE INVENTION --.

Signed and Sealed this

Twenty-third Day of August, 2005

JON W. DUDAS
*Director of the United States Patent and Trademark Office*